US005513776A

United States Patent [19]

Canini

[11] Patent Number: 5,513,776

[45] Date of Patent: May 7, 1996

[54] SHAKER FOR FINE TABLE SALT

[76] Inventor: Ferruccio Canini, Via Acerbi 15/3, I-16148 Genova, Italy

[21] Appl. No.: 318,689

[22] PCT Filed: Feb. 8, 1994

[86] PCT No.: PCT/IT94/00010

§ 371 Date: Oct. 11, 1994

§ 102(e) Date: Oct. 11, 1994

[87] PCT Pub. No.: WO94/17704

PCT Pub. Date: Aug. 18, 1994

[30] Foreign Application Priority Data

Feb. 11, 1993 [IT] Italy ..... GE93A0007
Mar. 15, 1993 [IT] Italy ..... GE93A0021

[51] Int. Cl.[6] ..... B65D 83/06

[52] U.S. Cl. ..... 222/149; 222/196.3; 222/510; 222/548; 222/565

[58] Field of Search ..... 222/148–151, 222/196.3, 510, 548, 555, 480, 565

[56] References Cited

U.S. PATENT DOCUMENTS 618,833 2/1899 Binley ..... 222/151
792,428 6/1905 Lease ..... 222/149 X
1,545,226 7/1925 Baltzley ..... 222/149 X
1,978,596 10/1934 Otte ..... 222/149
2,545,240 3/1951 Patoe .
2,565,774 8/1951 Maud .
3,228,569 1/1966 Jaccard et al. ..... 222/196.3
3,262,614 7/1966 Allen ..... 222/548 X
4,106,672 8/1978 Tecco et al. ..... 222/151

FOREIGN PATENT DOCUMENTS 2258391 10/1993 United Kingdom .

*Primary Examiner*—Kevin P. Shaver
*Attorney, Agent, or Firm*—Rosenman & Colin

[57] ABSTRACT

A simple, molded salt or spice shaker is disclosed. The shaker has a cap and an undercap that are rotatable relative to each other. Their rotation also rotates projections that engage the salt or spice material so as to break up lumps that might block the shaker and causes bosses on the undercap to be inserted into dispensing holes in the cap so as to clear the path to the holes and to eject the material from the dispensing holes.

9 Claims, 2 Drawing Sheets

SHAKER FOR FINE TABLE SALT

BACKGROUND OF THE INVENTION

1. Field of the Invention

The present invention is related to dispensers for powdered and granular materials. More particularly, the present invention is directed to dispensers that prevent such materials from blocking the dispenser.

2. Discussion of Related Art

Generally, it is known that the drawback of all dispensers for fine table salt, or salt shakers marketed in various shapes, is that, after a certain time from replenishment with new salt, as a result of the tendency of salt to become clotted due to humidity, they do not permit the salt therein to be dispensed in due course. Therefore, the perforated closing cap must be unscrewed and cleaned internally to remove the clotted salt, which operation is simple but tiresome and is unpleasant to operators of public restaurants due to the complaints from the customers. Often, the salt is dispensed unevenly, or excessively due to the repeated shaking of the salt dredger, thus spoiling the food.

SUMMARY OF THE INVENTION

The article proposed by the invention is the result of improvements made in response to these drawbacks and is adapted to advantageously eliminate them. Substantially, the container of the salt dredger thus developed comprises a manually rotatable closing cap having a series of dispensing holes orderly arranged circumferentially. The cap is adapted to be mounted on an undercap made of resilient material and fixedly snap-mounted on the open end of said body of the container. The top of the undercap is formed with a wide passage opening, and the edge thereof is provided, at the top level, with inwardly-directly flexible projections carrying upwardly protruding bosses which, when these members (i.e. cap and undercap) are assembled, will rub elastically against the inner mouths of the dispensing holes to clear them, also provided ejecting action to clear them of the salt that has possibly clogged said holes. In addition, the cap may be provided on the inner side thereof with one or more tips or other projections which, by penetrating the salt in the container, will loosen or crumble it if it's clotted to render it flowable again. This loosening action is obtained simultaneously by rotating the cap with respect to the container.

BRIEF DESCRIPTION OF THE DRAWING

The accompanying drawings show, as a non-limiting example, a basic embodiment of the article according to the invention, as well as some possible advantageous and exemplary modifications. In the drawings.

DETAILED DESCRIPTION OF A PREFERRED EMBODIMENT

Figure 1:
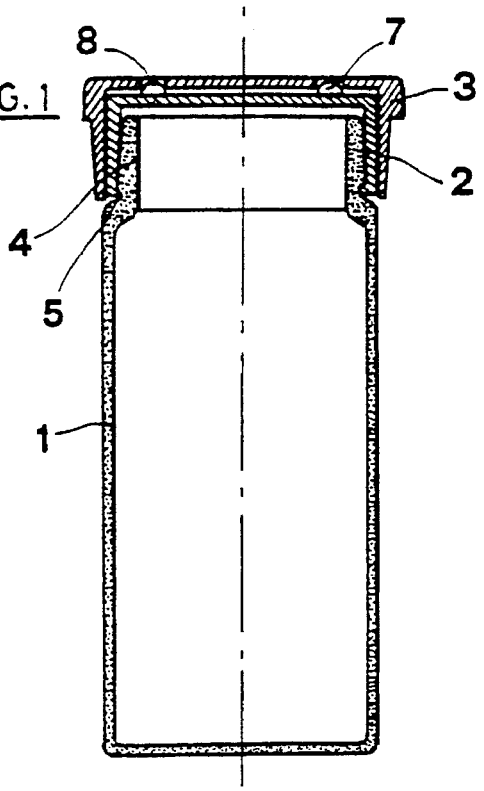
FIG. 1 is a general, axial sectional view of the basic embodiment of the salt shaker according to the invention.

As clearly shown in the drawings, and more particularly in the FIGS. 1 to 5, the salt shaker according to the invention, in its basic embodiment, substantially comprises a containing body 1, an undercap 2, a cap 3 rotatably mounted on said undercap which, in contrast, is mounted fixedly. The containing body 1, in this specific embodiment, is of cylindrical cup-shaped configuration, but obviously it may be of any other suitable configuration provided it satisfies functionality and aesthetics. Preferably, it is made of glass, but other materials of similar characteristics may be used.

Figure 2:
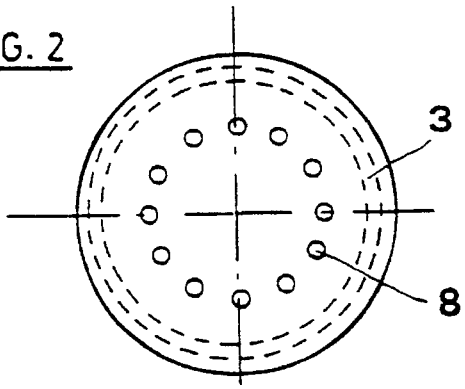
FIG. 2 is a plan view of the perforated cap.
Figure 3:
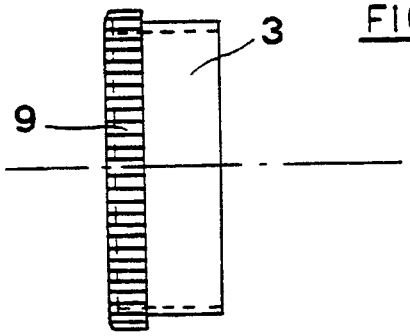
FIG. 3 is a side view of said cap having a knurled grasping edge.
Figure 4:
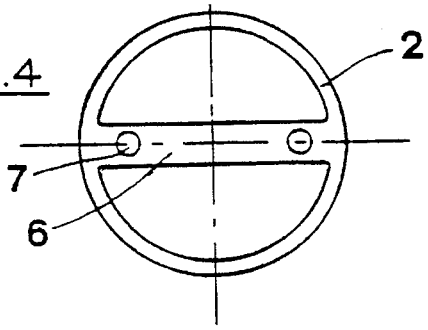
FIG. 4 is a plan view of the undercap with a cross member and a pair of protruding bosses thereon.
Figure 5:
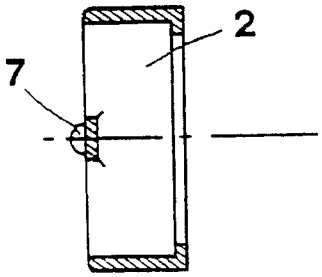
FIG. 5 is an axial sectional view of the undercap of FIG. 4.

At the top, the mouth is formed as a wide opening, and the neck 4 has an outer frusto-conical configuration, said neck having on its outer side a circular groove 5 for snap-engagement with the undercap 2. The undercap 2 is made if flexible plastics such as polyethylene or the like, is provided with a lower edge with an annular snap-engagement rib and is designed for friction fit so as to prevent its easy rotation. Finally, as best shown in FIG. 4, the undercap 2 comprises, as a peculiar characteristic of the invention, a small cross-member 6, integrally formed in the moulding step and located at the level of the top plane of the undercap, the remaining area of said plane being opened. The crossmember 6 comprises on its upper side a pair of diametrically opposite hemispheric bosses 7 protruding upwards and equally spaced from the center, which due to their positioning have a certain degree of elastic movement axially. The assembly is completed by a cap 3 which, as best shown in FIGS. 2 and 3, is of cup-shaped configuration with a planar bottom which, in register with the bosses 7 of the undercap 2, is provided with a circumferential series of diametrically-opposite holes having an internal flaring shape. The inner diameter of the cap 3 is such as to enable its easy assembling onto the undercap 2, so as to permit the cap to be rotated manually with respect thereto when the salt dredger is to be restored if the salt therein has become clotted. In order to ease said operation, the edge 9 of the cap is knurled to improve grasping. By rotating the cap 3, said bosses 7 will rub elastically against the inner side of the holes 8, while the side edges of the crossmember 6 will remove the salt, and these actions cause together the restoration of the salt shaker.

Figure 6:
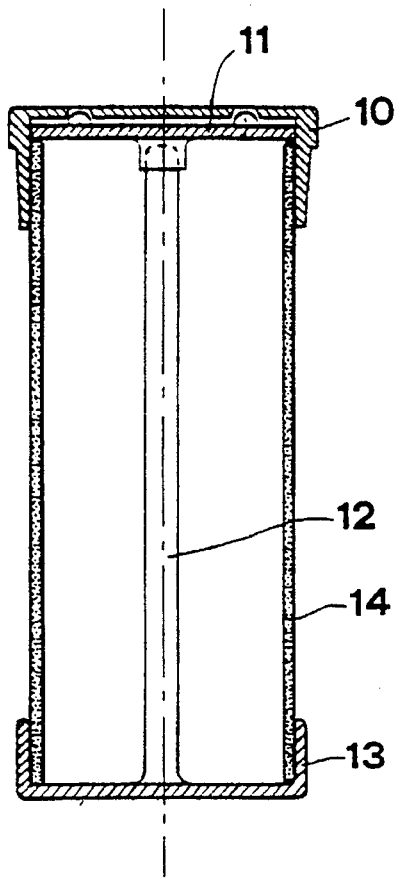
FIG. 6 is an axial sectional view of a first possible modification.

The same result, ensured again by the system with bosses 7 rubbed elastically against the inner mouths of the dispensing holes 8 can also be obtained by providing, as shown by the modification of FIG. 6, a stationary cap 10, a rotating member 11 with crossmember and bosses actuable through a small rod 12 secured to a rotatable cap 13 fitted on the lower end of the container 14, the latter cap being knurled circumferentially to improve grasping.

Figure 7:
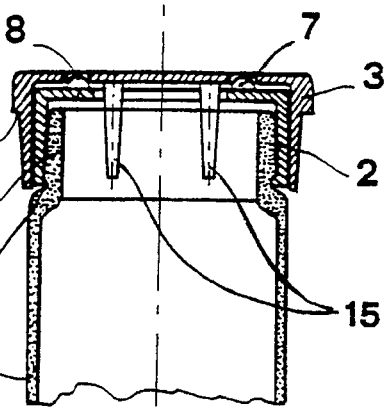
FIG. 7 is a general, axial sectional view of a second possible modification, the container body being shown only in part.
Figure 8:
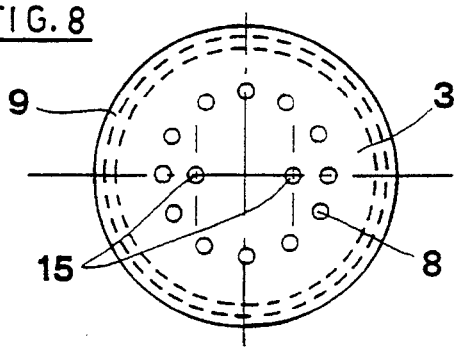
FIG. 8 is a plan view of the perforated cap provided with inwardly projecting tips for the modified embodiment of FIG. 7.
Figure 9:
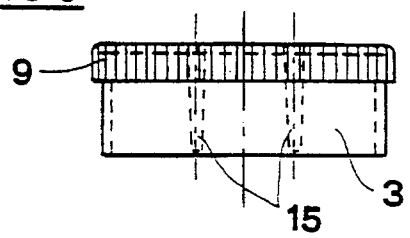
FIG. 9 is a side view of said cap with knurled grasping edge.
Figure 10:
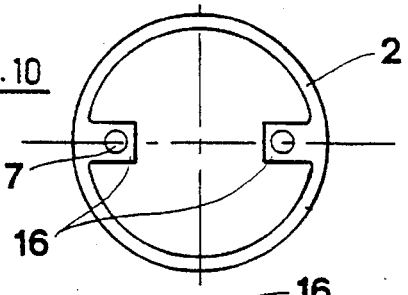
FIG. 10 is a plan view of the undercap for the modified embodiment of FIG. 7, with upwardly-projecting bosses formed on opposite internal projections.
Figure 11:
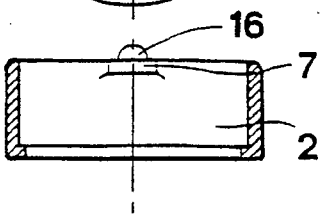
FIG. 11 is an axial sectional view of the undercap of FIG. 10.
Figure 12:
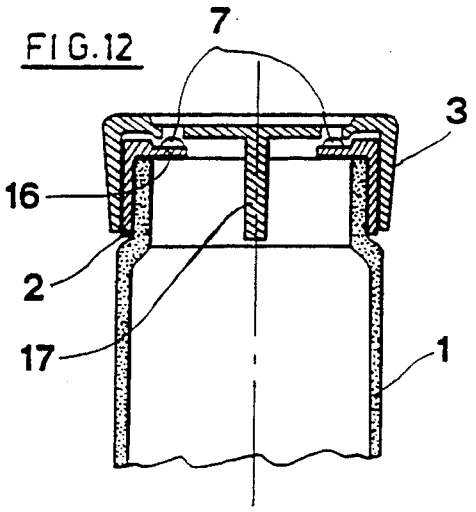
FIG. 12 is a fragmentary axial sectional view of the modified embodiment of FIG. 7, wherein the inwardly-projecting tips (15) of the cap are replaced by a single longitudinal spatula (17) secured to said cap.

Obviously, as shown in the examples of FIGS. 7 and 12, further modifications are possible that are consistent with the basic principle set forth above. Mainly, in order to ensure a higher performance without requiring further manual operations, auxiliary means may be provided internally to crumble or loosen the salt that possibly has become clotted at a certain distance from the dispensing holes. Said means, as shown in the Figures mentioned above, without requiring any modification to the main body of FIGS. 1 to 6, may be formed by a pair of tips 15 protruding from the inner side of the cap 3. Said tips are designed to pass through the undercap 2 and penetrate the salt in the container to stir said salt by rotating the cap 3 to which they are secured. In this case, to permit the tips 15 to rotatably pass therethrough, the central portion of the crossmember on the undercap is removed and only two end portions thereof are left to form a pair of projections 15 carrying the bosses 7 as shown in FIG. 10 similarly to the original arrangement. Said tips 15 of FIG. 7, as seen in FIG. 12, may be replaced by a single spatula-like projection 17 secured to the inner disc-shaped surface of the cap 3. By rotating the cap with respect to the container, said spatula-like projection, being aligned with a diameter of the cap, can stir the salt that possibly has become clotted.

Figure 13:
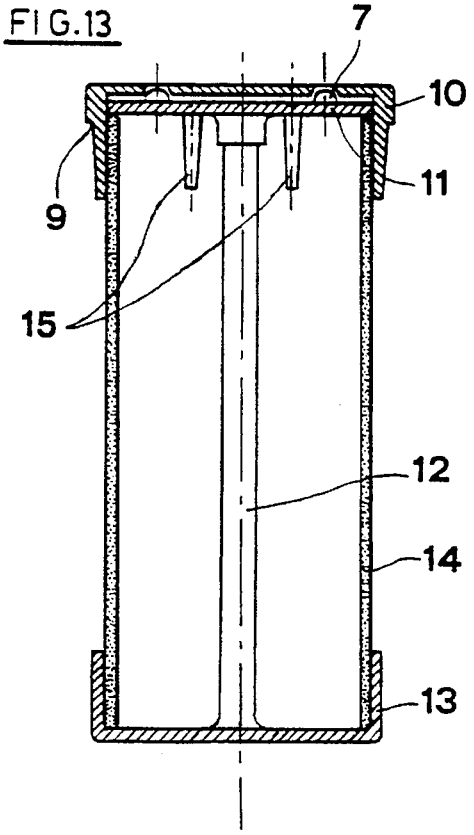
FIG. 13 is a general, axial sectional view of a further possible modification.

It is to be noted that in the modification of FIG. 13, which reflects the previous embodiment of FIG. 6, the tips 15 are secured to the inner side of the rotating member 11.

Finally, the invention contemplates that snap-engagement means are provided between the undercap 2 and cap 3 to ensure a mutual engagement without interfering with the freedom of their rotation, and also that the projections 16 on the undercap 2, carrying the bosses 7, may be formed integrally with the inner edge of the mouth of the container 1, thus avoiding the use of the undercap 2. The invention includes as well a simplified embodiment of the salt dredger, wherein the means against clogging are limited to a plain crossmember or any other means acting as a spatula within the cap 3 when the latter is rotated manually.

Further changes and modifications may be made to the invention as above described and shown, still within the basic principle of the invention and also for use with spices and the like.

I claim:

1. A shaker for a granular or powdered material, said shaker comprising:

a container body having a mouth; and sifting means for sifting said material, said sifting means including a cap having dispensing holes disposed along a circumference of said cap, said cap covering said mouth, and a molded undercap mounted on the mouth of the container body, said undercap having an opening providing passage for the material through said undercap, said undercap having one or more bosses molded thereon so as to elastically contact said cap and be inserted into said dispensing holes when said cap rotates relative to said undercap, and internal projections molded on said sifter, said projections extending from a central portion of said sifter so as to extend into said container body and engage the material, whereby the material is prevented from clotting and blockage of the shaker is prevented.

2. The shaker according to claim 1, wherein said molded bosses are hemispherical and contact a flared inner end of said holes when said cap rotates relative to said undercap.

3. The shaker according to claim 1, wherein said bosses are mounted on respective radial resilient tabs so that said tabs loosen clotted material near the holes and eject it from said holes, whereby passage of the material is assured.

4. The shaker according to claim 1 wherein said internal projections are molded on said cap extending from a central portion of said cap, said opening further comprising:

a central opening in said undercap, said opening in said undercap permitting said projections to extend into said container body so as to engage the material, whereby the material is prevented from clotting.

5. The shaker according to claim 1 wherein said internal projections are molded on said undercap, said projections extending from a central portion of said undercap, said projections extending into said container body so as to engage the material, whereby the material is prevented from clotting.

6. The shaker according to claim 1, wherein aid cap is fixed on the mouth of the container body and said undercap is rotatable relative to the container body, said shaker further comprising:

a second mouth on the container body;

an actuator cap closing said second mouth, said actuator cap being rotatable relative to the container body;

a drive rod connecting said actuator cap to said undercap so that said undercap rotates relative to the container body when said actuator cap is rotated relative to the container body; and said projection comprising a pair of projections molded on the undercap, said projections extending from a central portion of said undercap, said projections extending into said container so as to engage said material, whereby the material is prevented from clotting.

7. The shaker according to claim 1, wherein said bosses are mounted on respective resilient tabs so that said tabs loosen material clotted near the holes and eject it from said holes, said tabs being molded as an integral part of said mouth of the container body.

8. A shaker for a granular or powdered material, said shaker comprising:

a container body having a mouth;

a cap having dispensing holes disposed along a circumference of said cap, said cap covering said mouth, said cap being rotatable relative to said container body;

a molded undercap fixedly mounted on the mouth of the container body, said undercap having an opening providing passage for the material through said undercap, said undercap including a radial support with one or more bosses molded thereon so as to elastically contact said cap and to be inserted into said dispensing holes when said cap is rotated relative to said undercap so clotted material near the holes is cleared and ejected from said holes, whereby blockage of the shaker is prevented.

9. A shaker for a granular or powdered material, said shaker comprising:

a container body having a mouth;

a cap having dispensing holes disposed along a circumference of said cap, said cap covering said mouth, said cap being rotatable relative to said container body said cap having an internal spatula-like projection molded thereon, said spatula-like projection being aligned with a diameter of said cap and extending from a central portion of said cap;

a molded undercap fixedly mounted on the mouth of the container body, said undercap having a central opening providing passage for the material through said undercap, said opening permitting said projection to extend into said container so as to engage the material, said undercap having one or more bosses molded thereon so as to elastically contact said cap and to be inserted into said dispensing holes when said cap is rotated relative to said undercap, whereby the material is prevented from clotting and blockage of the shaker is prevented.

* * * * *